United States Patent [19]

Yamaguchi et al.

[11] Patent Number: 4,649,248

[45] Date of Patent: Mar. 10, 1987

[54] ANNEALING FURNACE FOR ANNEALING MAGNETIC CORES IN A MAGNETIC FIELD

[75] Inventors: Hiroshi Yamaguchi, Akashi; Teruaki Tanaka, Kobe; Masatake Hirai, Kyoto; Tadashi Kohketsu; Masahiro Matsumoto, both of Nagoya; Kenji Kawate, Inuyama, all of Japan

[73] Assignee: Allied Corporation, New York, N.Y.

[21] Appl. No.: 741,255

[22] Filed: Jun. 4, 1985

[30] Foreign Application Priority Data

| | | | |
|---|---|---|---|
| Jun. 5, 1984 | [JP] | Japan | 59-114761 |
| Jun. 14, 1984 | [JP] | Japan | 59-126090 |
| Jul. 9, 1984 | [JP] | Japan | 59-142077 |

[51] Int. Cl.[4] ..... H05B 6/10

[52] U.S. Cl. ..... 219/10.57; 219/10.71; 148/103; 148/108

[58] Field of Search ..... 219/10.57, 10.69, 10.71, 219/10.73, 10.75, 10.79, 10.49 R, 10.67, 10.43; 148/103, 108, 13; 266/128, 129

[56] References Cited

U.S. PATENT DOCUMENTS

| | | | |
|---|---|---|---|
| 2,342,532 | 2/1944 | Doelker | 219/10.57 X |
| 2,810,053 | 10/1957 | Messner | 219/10.79 X |
| 4,246,461 | 1/1981 | Jeppson | 219/10.71 X |
| 4,311,896 | 1/1982 | Junya | 219/10.57 |
| 4,355,221 | 10/1982 | Lin | 219/10.75 X |
| 4,524,342 | 6/1985 | Mas . | |
| 4,531,036 | 7/1985 | Lewis | 219/10.43 |

FOREIGN PATENT DOCUMENTS

| | | |
|---|---|---|
| 58-115805 | 7/1983 | Japan . |

*Primary Examiner*—Philip H. Leung

*Attorney, Agent, or Firm*—Scully, Scott, Murphy & Presser

[57] ABSTRACT

An annealing furnace for annealing magnetic cores therein. Each magnetic core is placed on a tray on which the core is transferred on rollers through the furnace along with a conductive magnetizing conductor or shaft positioned inside the core and a current source for supplying a current to the conductive magnetizing shaft. After the tray, core and current source pass through the furnace, the annealed core is removed from the tray, and the tray and current source are returned to the furnace entrance for reuse with another core.

4 Claims, 10 Drawing Figures

ANNEALING FURNACE FOR ANNEALING MAGNETIC CORES IN A MAGNETIC FIELD

FIELD OF THE INVENTION

The present invention relates to a furnace for annealing magnetic cores in magnetic field.

BACKGROUND OF THE INVENTION

Recently, there have been developed amorphous metal alloys having excellent magnetic properties. In order to utilize such properties effectively, there has been proposed an application of amorphous metal alloys to the magnetic core of a transformer or the like (See, for instance JP-A No. 115805/1983).

As is disclosed in the reference cited, a magnetic core is formed of a coiled strip material of an amorphous metal alloy having a very thin thickness. Such a magnetic core has an advantage in that the magnetic energy loss can be reduced considerably when compared with that of a conventional magnetic core made of steel. However, there is a disadvantage in that it is difficult to manufacture the magnetic core since it should be annealed in an inert gas of about 400° C. applying magnetic field thereto.

Conventional method for annealing the magnetic core in the magnetic field are as follows;

first, a coil for magnetizing the magnetic core is wound around the latter, and, thereafter, each core is charged into an annealing furnace together with the magnetizing coil. After evacuation of gas in the furnace, inert gas is introduced thereinto and the temperature in the furnace is raised to a predetermined temperature to anneal the core in magnetic field being generated by the magnetizing coil.

However, the conventional method mentioned above has a disadvantage in that treatments therefor are troublesome since magnetizing coils are respectively wound around every magnetic core. Further, cost for annealing treatment becomes high since it is necessary to use an electrically conductive wire material covered with a heat proof insulating material as the magnetizing coil.

Contrary to the above, there is also proposed another annealing method in which a plurality of magnetic cores are fitted to a common magnetizing shaft made of electrically conductive material and are annealed in the magnetic field generated by supplying an appropriate current to the shaft.

These conventional methods mentioned above are essentially so called "batch process". Therefore, it is impossible to obtain annealed cores continuously. Moreover, thermal efficiency of the annealing furnace is very low as is easily understood by those skilled in the art.

SUMMARY OF THE INVENTION

An essential object of the present invention is to provide an annealing furnace being capable of annealing magnetic cores in the magnetic field to obtain annealed cores continuously.

To this end, according to the present invention, there is provided an annealing furnace comprising;

a furnace body for forming at least an annealing chamber therein, a plurality of tray means for supporting magnetic cores thereon respectively, means for transporting the magnetic cores in the annealing chamber, a plurality of magnetizing means for magnetizing magnetic cores in the annealing chamber each of which has at least a portion being movable together with the magnetic core, and a source for supplying electric current to each of magnetizing means.

BRIEF DESCRIPTION OF THE DRAWINGS

The present invention will be more fully understood and further advantages will become apparent when reference is made to the following detailed description of the accompanying drawings in which.

DESCRIPTION OF PREFERRED EMBODIMENTS [First Embodiment]

Figure 1:
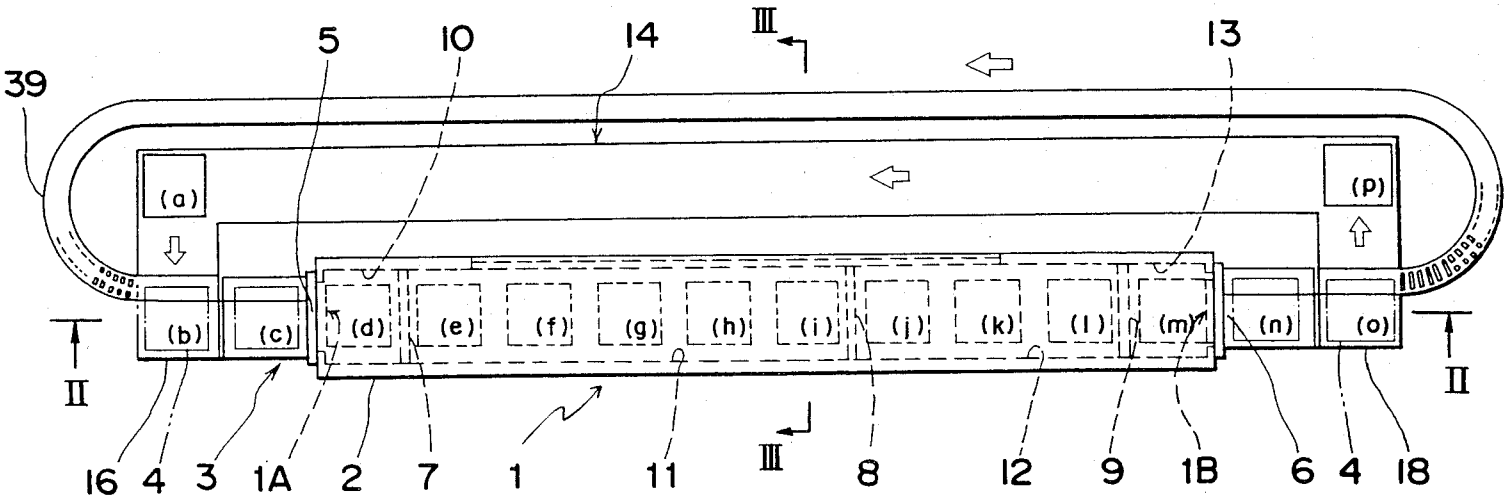
FIG. 1 is a schematical plan view showing a furnace according to a first embodiment of the present invention.
Figure 2:
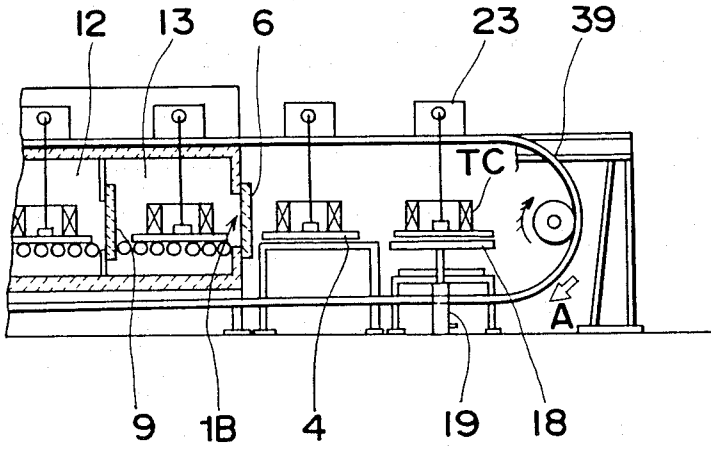
FIG. 2 is a schematical sectional view of the furnace sectioned along line II—II of FIG. 1.
Figure 3:
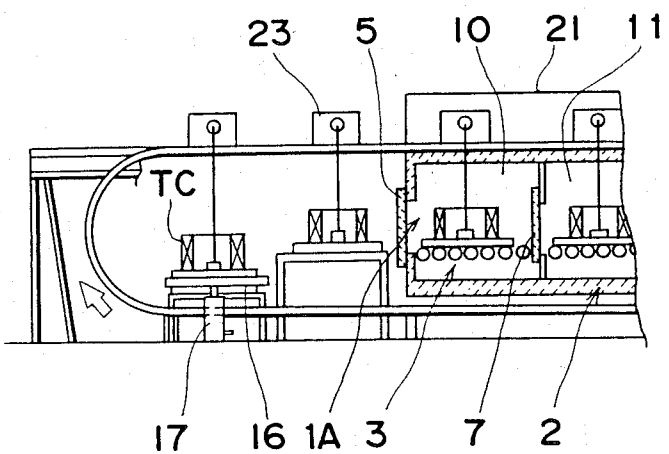
FIG. 3 is a schematical sectional view of the furnace sectioned along line III—III of FIG. 1.
Figure 3:
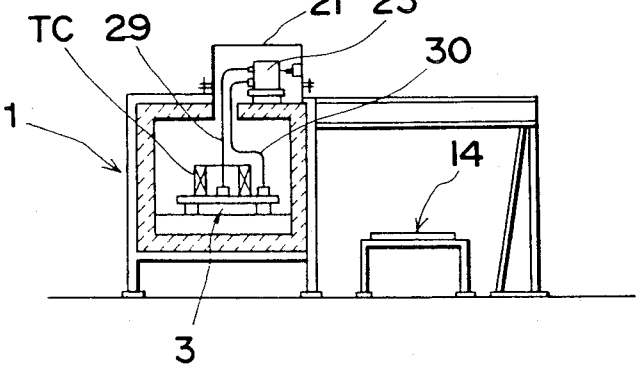

Referring to FIGS. 1, 2 and 3, an annealing furnace 1 provides a furnace body 2 forming chambers therein and a transporting roller table means 3 for transporting trays 4 in the furnace 1.

The entrance 1A of the furnace 1 is usually closed by an entrance door 5 which is operated to open the entrance upon charging a toroidal core TC to be annealed. Also, the exit 1B of the furnace 1 is usually closed by an exit door 6 which is operated to open the exit upon discharging a toroidal core TC having been annealed already.

The internal space of the furnace 1 from the entrance 1A to the exit 1B is partitioned into four chambers by three partition doors 7, 8 and 9. A small chamber 10 defined between doors 5 and 7 is a charging vestibule for charging the toroidal core TC. An elongated chamber 11 defined between doors 7 and 8 is formed as a heating chamber for heating cores TC therein. A chamber 12 defined between doors 8 and 9 is formed as a cooling chamber for cooling cores TC and a small chamber 13 defined between doors 9 and 6 is a discharging vestibule. Inert gas is supplied into the heating chamber 11 and cooling chamber 12 from the source of inert gas (not shown).

The transporting roller table means 3 transports trays 4, 4, . . . each advancing the toroidal core TC thereon at a predetermined pitch at every time interval predetermined according to annealing conditions. Other transporting means 14 is provided for returning blank trays from the discharging side to the charging side. In order to receive a blank tray and put a toroidal core TC thereon, there is provided a transferring table 16 between the end of charging side of the transporting means 14 and the beginning end of the first transporting roller table means 3. The transferring table 16 is supported by a hydraulic cylinder means 17 so as to move up and down between two positions. At the lower position, the transferring table 16 receives a blank tray returned and, at the upper position, it transfers the tray together with a toroidal core TC being put thereon to the transporting roller table means 3. At the discharging side of the transporting roller table means 3, there is also a transferring table 18 providing a hydraulic cylinder means 19. The transferring table 18 receives a tray discharged from the furnace 1 at the upper position and, after the toroidal core TC is removed, the blank tray is transferred to the other end of the returning means 14.

Figure 4:
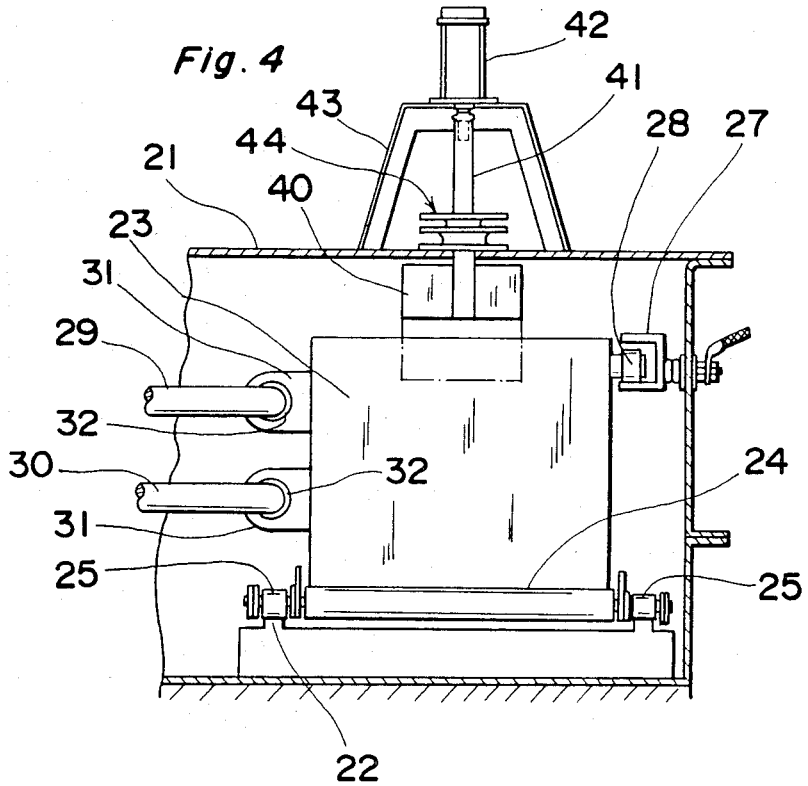
FIG. 4 is a sectional view of the seal box.

As shown in FIGS. 2 and 3, there is provided a sealing box 21 on the ceiling wall of the furnace 1 in the longitudinal direction thereof. As is shown in FIG. 4 more clearly, there is provided a guide rail 22 in the longitudinal direction in order to guide a current source 23. The current source 23 is put on free roller table 24 slidably and the free roller table 24 is moved by driving drive rollers 25. There is provided a rail 27 inside of one side wall of the sealing box 21. The current source 23 has a current contacting roller 28 contacting inside of the rail 27 to which electric current is supplied through terminal tip from an external current source (not shown). The rail 27 is provided in the range defined from the tray indicated by "f" to the tray indicated by "k" in FIG. 1.

Figure 5:
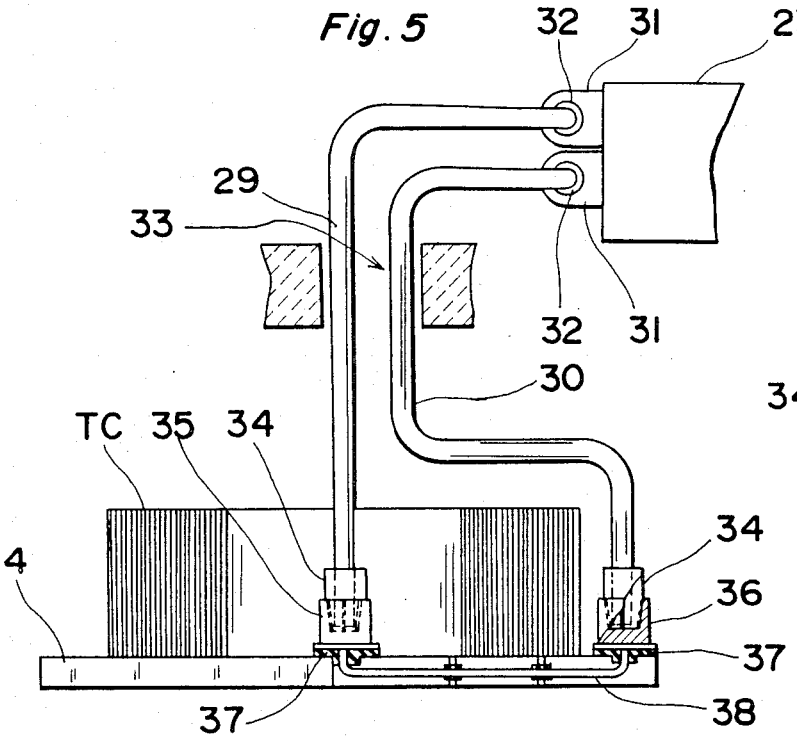
FIG. 5 is a front view showing a magnetizing coil unit.

As is shown in FIG. 5 clearly, the current source 23 supports two rod members 29 and 30 on brackets 31 projected from the side wall of the source 23 with couplings 32 respectively. The first and second rod members 29 and 30 are respectively so bent as to project in the internal space of the furnace passing through a slot 33 formed along the longitudinal direction of the ceiling of the furnace, and have plugs 34 being fixed at their free ends respectively. In order to accept the plugs 34, there are provided sockets 35 and 36 at the center of the tray and at one peripheral position thereof respectively. These socket members 35 and 36 are supported on the tray with insulating members 37 respectively in order to insulate sockets against the tray. These two sockets members 35 and 36 are electrically connected by a connecting rod 38 being arranged in the tray.

As the result of structures mentioned above, an electro-magnetic coil is formed by the first rod 29, the plug 34, the socket 35, the connecting rod 38, the socket 36, the plug 34 and the second rod 30. Therefore, when an electric current is supplied to the coil, a magnetic field is generated to magnetize the toroidal core TC on the tray.

Figure 6:
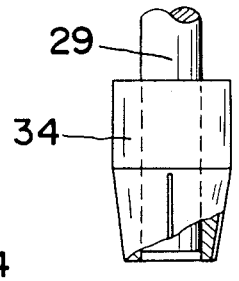
FIG. 6 is a partial view showing a coupling provided at one end of rod member.

It is desirable to form slits at the tapered portion of the plug 34 in the axial direction, as is shown in FIG. 6, in order to obtain a good electrical contact between the plug and the socket.

The guide rail 22 in the sealing box 21 is connected at the both ends thereof continuously to a chain conveyor 39, as is shown in FIGS. 1 and 2, so as to form a looped transporting means for the current sources 23.

As shown schematically in FIG. 2, the engagement between each plug of the rod and each socket of the tray is released when the transferring table 18 is lowered to transfer the toroidal core TC to another transporting means (not shown). After transferring the toroidal core TC, the source 23 is moved from the upper run of the chain conveyor 39 to the lower run thereof as indicated by an arrow A in FIG. 2. When the source 23 is moved around the corner of the chain conveyer to the upper run, the source 23 is stopped once just above the transferring table 16 being positioned at the lower position thereof.

When the table is lifted upto the upper position after putting a toroidal core TC on the tray thereon, as is shown in FIG. 5, each plug 34 of the collector 23 fits into the corresponding socket 35 or 36 to form a closed coil for magnetizing the toroidal core TC.

In order to position the source exactly, it is desirable to provide a stopper means 40 as shown in FIG. 4. The stopper means 40 is supported at the lower end of a plunger 41 of a pneumatic cylinder 42 mounted downwardly on a support frame 43 fixed on the ceiling of the sealing box. The hole of the ceiling for passing the plunger 41 therethrough is sealed by suitable sealing ring 44.

In operation of the annealing furnace, first, the transferring table 18 is lowered from the upper position to the lower position. When the table 18 is lowered, the source 23 becomes free from the tray and the toroidal TC having been annealed completed. Then, the toroidal core TC is brought out therefrom, the blank tray is transferred to the returning means 14 and the source 23 is moved to the lower run of the chain conveyor 39.

Thereafter, the tray indicated by "n" in FIG. 1 is transferred to the transferring table 18 together with the toroidal core TC and the source.

It is to be noted that the discharge vestibule 13 is usually kept as is understood from the mentioned hereinafter.

Next, the partition door 9 is opened and the trays indicated "j", "k" and "l" are moved by one pitch together with toroidal cores TC and sources.

Then, the partition door 9 is closed and the partition door 8 is opened. When the door 8 is opened, trays "e", "f", "g", "h" and "i" in the heating chamber 11 are moved by one pitch. Thereafter, the partition door 8 is closed.

Next, the partition door 7 is opened and the tray "d" in the charging vestibule 10 is transferred into the heating chamber 11.

Then, the entrance door 5 is opened and the tray "c" is charged into the charging vestibule 10. After charging a toroidal core TC, the entrance door 5 is closed. A toroidal core TC is put on a tray indicated by "a".

When the tray "c" is moved by one pitch, the tray "b" is moved by one pitch to occupy the position "c". The tray "a" putting the toroidal core TC thereon is moved to position "b". Thereafter, the transferring table 16 is lifted upto the upper position and, therefore, a magnetizing coil loop is formed as mentioned above.

Then, the exit door 6 is opened to discharge the tray "m" in the discharging vestibule 13 to the position "n". Finally, the exit door is closed to complete one cycle of the annealing.

[Second Embodiment]

Figure 7:
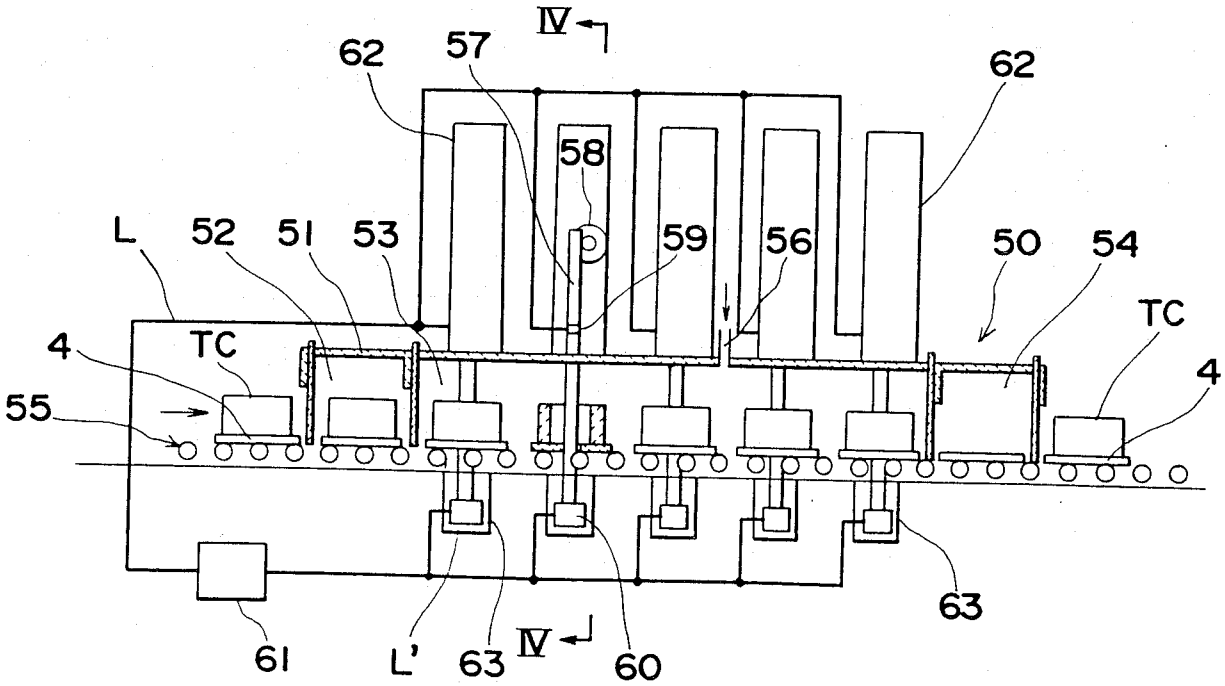
FIG. 7 is a schematical sectional view showing the second embodiment of the present invention.

As shown in FIG. 7 schematically, the annealing furnace 50 provides a furnace body 51 defining a charging vestibule 52, a heating chamber 53 and a discharging vestibule 54 therein and a transporting roller table means 55 for transporting trays each putting a toroidal core TC thereon at a predetermined pitch and at a predetermined timing. On the ceiling wall of the furnace 50, there is provided a tube 56 for supplying proper inert gas into the heating chamber 53 to maintain the inert atmosphere therein.

Further, a plurality of rod-like magnetizing electrodes 57 are provided for generating magnetic field to magnetize toroidal cores TC in the heating chamber 53. These magnetizing electrodes 57 are aligned in the longitudinal direction of the furnace at a predetermined pitch equal to that of the transportation of trays. Each magnetizing electrode 57 is guided in the vertical direction so as to be lifted up and down by a driving motor 58 passing through the ceiling wall, central window of the toroidal core TC and the tray.

To each magnetizing electrode 57, there are provided an upper and lower electrodes 59 and 60. Each upper electrode 59 is arranged above the furnace 51 so as to contact to the upper portion of the magnetizing electrode 57 wherever the latter is positioned.

Each lower electrode 60 is so arranged below the transporting roller table 55 as to contact with the lower end of the magnetizing electrode 57 when the latter is lowered as shown in FIG. 7. All of upper electrodes 59 are connected commonly to a lead line L and all of lower electrodes 60 are connected also to a lead line L'. These lead lines L and L' are respectively connected to output terminals of a current source 61 for supplying a magnetizing DC or AC current.

It is desirable to provide a cylindrical seal cover 62 detachably on the ceiling of the furnace in order to seal gas against the exterior which may be leaked out through the hole of the ceiling for passing the magnetizing electrode 57. Lower seal covers 63 are provided below the bottom of the furnace at every portion where the magnetizing electrode 57 passes through in order to seal said portion including the lower electrode 60 against the exterior.

Figure 8:
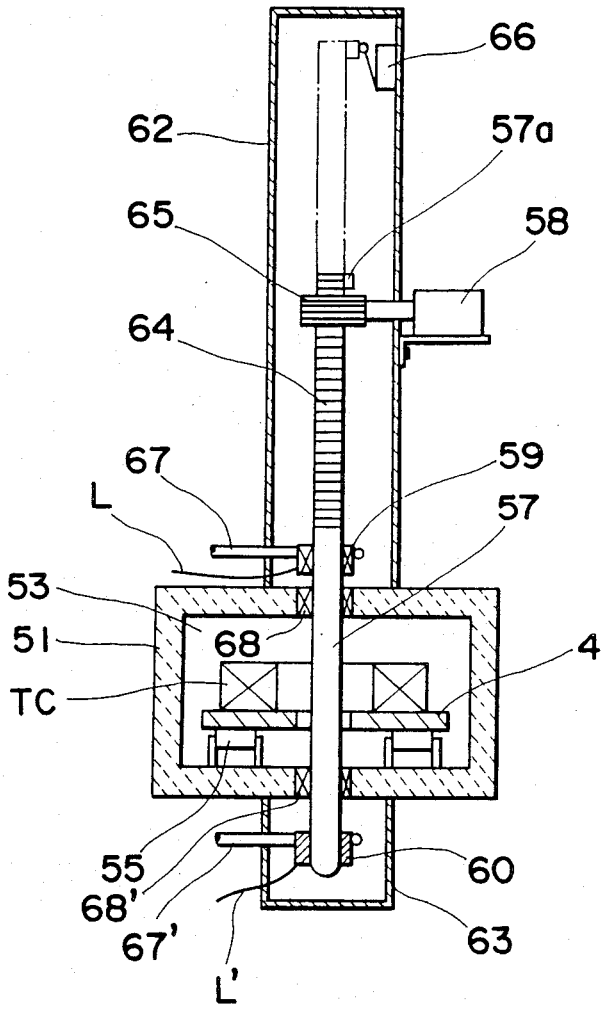
FIG. 8 is an enlarged sectional view sectioned along line IV—IV of FIG. 7.

As shown in FIG. 8, the lower end of the magnetizing electrode 57 is formed rounded in order to make the contact between the magnetizing electrode 57 and the lower electrode 60 smooth. On the upper half portion of the magnetizing electrode 57, there is formed a rack gear 64. The rack gear 64 is engaged with a rack pinion 65 being mounted coaxially on the driving shaft of the motor 58 which is fixed at the middle portion of the seal cover 62. Therefore, the magnetizing electrode 57 is lifted up from the lower position shown by solid line to the upper position indicated by phantom line by driving the motor as shown in FIG. 8.

When the magnetizing electrode 57 is lifted up to the upper position, the lower end thereof is lifted higher than the upper surface of the toroidal core TC on the tray. Therefore, it becomes possible to advance the tray together with the toroidal core TC by one predetermined pitch. A limit switch 66 is mounted on the upper portion of the side wall of the seal cover 62 which is operated cooperatively with a projection **57*a* provided at the top of the magnetizing electrode 57** in order to detect that the latter is lifted up to the upper position.

It is desirable to cool the upper and lower electrodes 59 and 60 with cooling water being fed through each cooling tube 67 and 67' in order to prevent a possible rising of the temperature thereof. Further, heat-proof slide bearings 68 and 68' with seals are respectively arranged so as to seal each hole through which the magnetizing electrode 57 passes.

After the tray is transferred together with the toroidal core TC by one pitch, the magnetizing electrode 57 is moved downwardly to the lower position at which the lower end of the magnetizing electrode 57 is contacted to the lower electrode 60. Thereafter, the current source is turned on to supply the magnetizing current to the magnetizing electrode 57 through the upper and lower electrodes 59 and 60. Therefore, every toroidal core TC in the heating chamber is annealed in the magnetic field generated by the magnetizing electrode 57.

Since the manners of charging and/or discharging toroidal cores TC are substantially same to those mentioned in the first embodiment, they are abbreviated for brevity.

Although the magnetizing electrode 57 is driven by the rack-pinion mechanism in this second embodiment, it is possible to drive the same by a chain driving mechanism or a hydraulic or pneumatic cylinder means.

Further, the transporting means for trays is not limited to the roller table conveyer, but pusher means being capable to move each tray by one pitch is applicable as the transporting means.

[Third Embodiment]

In the third embodiment of the present invention, each toroidal core TC is supported on the tray in such a manner that the axis of the toroidal core TC is parallel to the surface of the tray.

Figure 9:
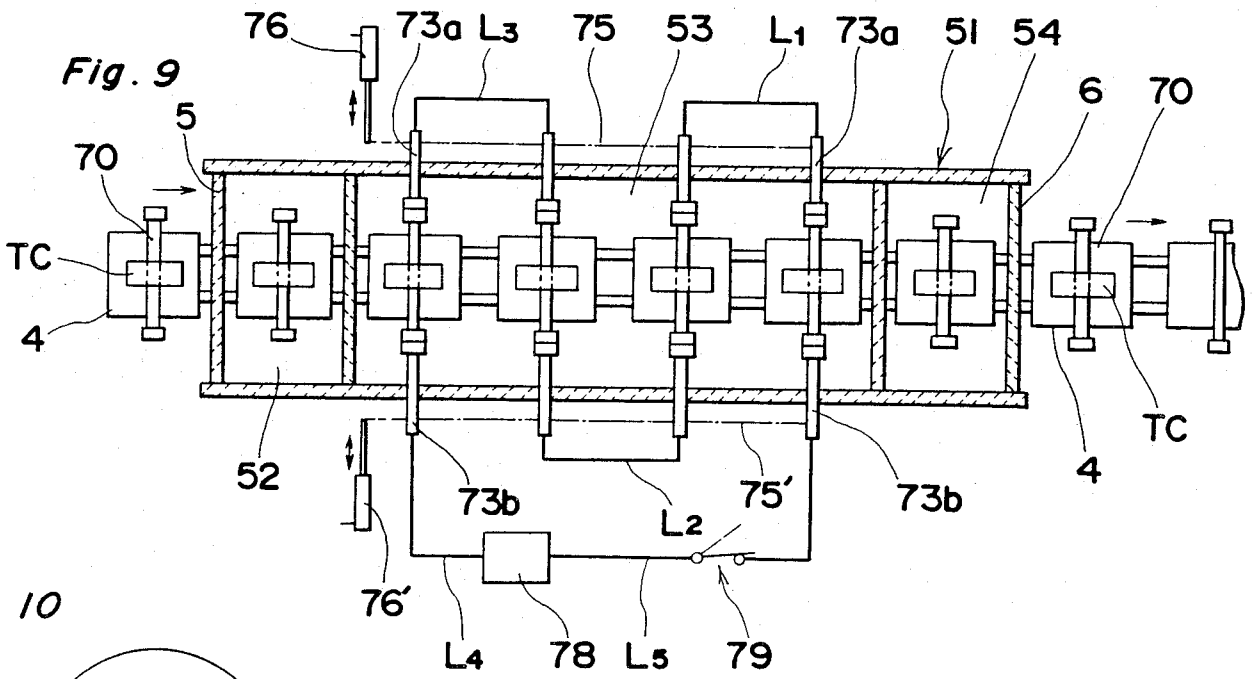
FIG. 9 is a schematical sectional view showing the third embodiment of the present invention.
Figure 10:
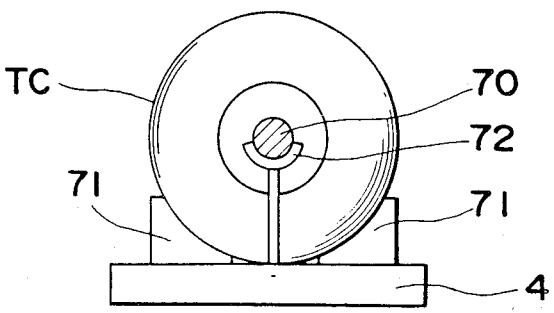
FIG. 10 is a side view showing a tray and a troidal core according to the third embodiment.

As is shown in FIGS. 9 and 10, a magnetizing electrode 70 is inserted in the axial direction of the toroidal core TC being put on the tray. As is clearly shown in FIG. 10, there are provided a pair of holder elements 71, 71 for holding the toroidal core TC not to rotate and a pair of holder arms 72, 72 for holding the magnetizing electrode 70 in the axial direction of the troidal core TC.

As is shown in FIG. 9, there are arranged a plurality of movable electrodes **73*a*, 73*a*, . . . and 73*b*, 73*b*, . . . along each of side walls of the heating chamber 53. Each movable electrode 73*a* or 73*b* is slidably projected into the heating chamber 53 in such a manner that it is coaxial with the magnetizing electrode 70 inserted in the axial direction of the troidal core TC. All the movable electrodes 73*a* arranged on one side wall are supported commonly by a connecting means 75. The connecting means 75 is connected to a hydraulic or pneumatic cylinder 76. The cylinder 76 is operated to move movable electrodes 73*a*, 73*a*, . . . between a first position at which the contact provided on the free end of each movable electrode is contacted with the contact provided on one end of the magnetizing electrode 70** and a secod position at which each movable electrode is parted from the magnetizing electrode to allow the transfer of trays.

Similarly, all the movble electrodes **73*b*, 73*b*, . . . arranged on the other side wall of the furnace are supported commonly by a connecting means 75' which is operated by a hydraulic or pneumatic cylinder 76'**.

As is shown in FIG. 9 all the magnetizing electrodes of the toroidal cores TC charged into the heating chamber 53 are connected in series, via movable contacts **73*a*, 73*a*, . . . and 73*b*, 73*b*, . . . to a current source 78 by lead lines $L_1$, . . . , $L_5$. On the way of the lead line $L_5$, a switching means 79** is provided.

Therefore, when the switch 79 is turned on in the state shown in FIG. 9, magnetizing current is supplied to each magnetizing electrode to generate magnetic fields for magnetizing each toroidal core TC.

Annealing processes of the third embodiment are substantially same to those of the first or second embodiment, particular explanations about those are abbreviated for brevity.

It is to be noted that the annealing furnace according to the present invention is suitable for annealing all the type of magnetic core having a closed or substantially closed shape as a circle, a rectangle or the like. Also, the material for the core is not limited to an amorphous metal alloy, but steel suitable for the magnetic core can still be used.

Having thus described the invention in rather full detail, it will be understood that these details need not be strictly adhered to, but that various changes or modifications may suggest themselves to those skilled in the art, all falling within the scope of the invention as defined by the claim.

What is claimed is:

1. A furnace for annealing magnetic cores in a magnetic field comprising:

a. a furnace body forming at least an annealing chamber and having a heat source therein;

b. a plurality of tray means, each of which is adapted to support a core thereon to be annealed in the furnace in a magnetic field;

c. means for transporting the plurality of tray means, each of which has a magnetic core thereon, through the annealing chamber;

d. a plurality of magnetizing means for generating a magnetic field for magnetic cores in the annealing chamber, each of which has at least a portion thereof movable between first and second positions, in said first position said portion being so positioned as to form a closed loop for generating a magnetic field for the core and, and in said second position said portion being removed from the core so as to allow the core to move relative thereto; and e. a current source for supplying electric current to each magnetizing means.

2. A furnace according to claim 1, wherein the magnetizing means is a magnetizing coil comprised of a pair of rod members connected to a current source, and a connecting means for conductively connecting to both ends of the rod members so as to form a closed loop which surrounds the trunk of a magnetic core positioned on a tray means.

3. A furnace according to claim 1, wherein the magnetizing means has a magnetizing electrode which is adapted to be inserted coaxially within a magnetic core.

4. A furance according to claim 1, wherein each tray means is adapted to support a magnetic core thereon placed horizontally on the tray means.

* * * * *